US011039656B2

(12) United States Patent
Norton

(10) Patent No.: US 11,039,656 B2
(45) Date of Patent: Jun. 22, 2021

(54) FOOTWEAR SHOCK ATTENUATION SYSTEM

(71) Applicant: OPVET Inc., Temple, TX (US)

(72) Inventor: Daniel E. Norton, Happy Valley, OR (US)

(73) Assignee: OPVET, Inc., Temple, TX (US)

( * ) Notice: Subject to any disclaimer, the term of this patent is extended or adjusted under 35 U.S.C. 154(b) by 0 days.

(21) Appl. No.: 13/940,598

(22) Filed: Jul. 12, 2013

(65) Prior Publication Data

US 2015/0013182 A1 Jan. 15, 2015
US 2020/0154820 A9 May 21, 2020

Related U.S. Application Data

(60) Provisional application No. 61/672,440, filed on Jul. 17, 2012.

(51) Int. Cl.
*A43B 13/02* (2006.01)
*A43B 13/18* (2006.01)
(Continued)

(52) U.S. Cl.
CPC ..... *A43B 7/144* (2013.01); *A43B 13/026* (2013.01); *A43B 13/14* (2013.01); *A43B 13/18* (2013.01); *A43B 13/183* (2013.01); *A43B 21/26* (2013.01)

(58) Field of Classification Search
CPC ..... A43B 7/32; A43B 7/125; A43B 13/185; A43B 13/186; A43B 21/32; A43B 13/18; A43B 13/10; A43B 7/144
(Continued)

(56) References Cited

U.S. PATENT DOCUMENTS 1,139,417 A * 5/1915 Hering ..... A43B 21/30 36/38
1,562,986 A * 11/1925 Musto ..... A43B 21/30 36/38

(Continued)

OTHER PUBLICATIONS

"Thermoplastic Elastomers (TPE) & Thermoplastic Rubber (TBR)". Timco Rubber. Mar. 2014. Web retrieved Mar. 31, 2015. http://www.timcorubber.com/rubber-materials/tpe.htm.*

(Continued)

*Primary Examiner* — Jillian K Pierorazio
(74) *Attorney, Agent, or Firm* — Christopher Mayle; Thomas E. LaGrandeur; Bold IP, PLLC

(57) ABSTRACT

The footwear cushioning invention includes a floating elastic plate that stores and returns elastic energy to provide cushioning through deflection of the elastic plate. Cushioning is by energy return rather than the compression of a foam. Footwear cushioning utilizes a deflection plate integrated into the heel of the shoe for providing shock attenuation and energy absorption when a wearer impacts a hard surface with the shoe. The deflection plate can be carbon fiber because it increases energy return and minimizes energy loss. A cavity can be formed in a midsole of the shoe underneath the deflection plate to allow the plate to flex into the cavity when pressed down upon by a wearer's heel, thereby accepting the energy of a downward step. A post can be located in the center of the cavity underneath the deflection plate that allows support and minimizes excessive deflection of the deflection plate.

11 Claims, 6 Drawing Sheets

(51) Int. Cl.
*A43B 7/14* (2006.01)
*A43B 21/26* (2006.01)
*A43B 13/14* (2006.01)

(58) Field of Classification Search
USPC ..... 36/173, 28, 35 R, 34 R
See application file for complete search history.

(56) References Cited

U.S. PATENT DOCUMENTS 3,188,755 A * 6/1965 Cortina ..... A43B 21/40 36/42
4,566,206 A 1/1986 Weber
4,709,489 A * 12/1987 Welter ..... 36/27
4,815,221 A * 3/1989 Diaz ..... A43B 13/183 36/27
5,224,280 A * 7/1993 Preman ..... A43B 13/181 36/107
5,255,451 A * 10/1993 Tong ..... A43B 3/0057 36/28
5,381,608 A * 1/1995 Claveria ..... 36/35 R
5,402,588 A * 4/1995 Graham ..... A43B 1/0072 36/114
5,649,374 A * 7/1997 Chou ..... A43B 21/30 36/27
5,718,063 A * 2/1998 Yamashita ..... A43B 1/0072 36/28
5,743,028 A 4/1998 Lombardino
5,901,467 A 5/1999 Peterson et al.
5,933,983 A * 8/1999 Jeon ..... A43B 21/28 36/29
6,233,846 B1 * 5/2001 Sordi ..... A43B 5/00 36/105
6,568,102 B1 5/2003 Healy et al.
7,020,988 B1 * 4/2006 Holden ..... A43B 7/1425 36/141
7,159,339 B2 * 1/2007 Mathieu ..... A43B 13/146 36/30 R
7,757,410 B2 7/2010 Aveni et al.
7,788,826 B2 9/2010 Frederick
7,810,254 B2 10/2010 Wu
7,937,854 B2 * 5/2011 Kilgore ..... A43B 13/20 36/27
8,171,656 B2 * 5/2012 Salminen ..... A43B 7/1425 36/107
8,296,969 B2 * 10/2012 Granger ..... A43B 1/0009 36/37
9,044,067 B2 * 6/2015 Edington ..... A43B 7/144
2002/0144430 A1 * 10/2002 Schmid ..... 36/27
2004/0250449 A1 * 12/2004 Testa ..... A43B 21/26 36/35 R
2006/0130364 A1 * 6/2006 Greene ..... A43B 7/1425 36/28
2006/0130365 A1 6/2006 Sokolowski et al.
2009/0019729 A1 * 1/2009 Nakano et al. ..... 36/91
2009/0200763 A1 * 8/2009 Adams ..... A43B 5/1633 280/11.19
2010/0071228 A1 * 3/2010 Crowley et al. ..... 36/28
2010/0299958 A1 * 12/2010 Mazzarolo ..... A43B 7/144 36/28
2011/0000101 A1 * 1/2011 Nakano ..... 36/12
2014/0259746 A1 * 9/2014 Abshire ..... A43B 13/185 36/29

OTHER PUBLICATIONS

"Glossary of Carbon Fiber and Composite Terminology". Hexcel. Mar. 2011. Web. retrieved Apr. 1, 2015. http://www.hexcel.com/resources/glossary.*
"Free-floating, adj", dictionary.com, web. Jun. 30, 2016.*
"Slide" The Free Dictionary by Farlex. Web. https://www.thefreedictionary.com/slide.*
"Firm" Dictionary.com. Web. https://www.dictionary.com/browse/firm.*
Oster, Jeffrey A., DPM. "Carbon Graphite Spring Plate": Product No. 882. Retrieved from www.myfootshop.com/detail.asp?productid=882, printed Jul. 12, 2013, 2 pages.

* cited by examiner

FOOTWEAR SHOCK ATTENUATION SYSTEM

INVENTION PRIORITY

This patent application claims the benefit under 35 U.S.C. § 119(e) of U.S. Provisional Application Ser. No. 61/672,440 entitled, "Footwear Shock Attenuation System," which was filed on Jul. 17, 2012 and is incorporated herein by reference in its entirety.

FIELD OF INVENTION

The present invention is in the technical field of footwear. More particularly, the invention is in the technical field of cushioning and support systems and devices for footwear. More particularly, the invention is in the field of cushioning that utilizes elastic energy through the utilization of the concept of deflection as a method of cushioning and energy return similar to a trampoline.

BACKGROUND

Conventional cushioning devices in footwear provide cushioning using the method of compression (usually via the incorporation of a foam material within the heel and sole of a shoe) to absorb shock within the footwear as a user is walking or running and the bottom of the footwear strikes the ground. Cushioning by compression is simply the process of compressing the material that is under your foot until it bottoms out with each step or stride. The drawback of using compression as a method of cushioning is that this form of cushioning has a high level of energy loss, deforms quickly, and looses up to 30% of its cushioning capabilities within the first 200 miles of use. Two hundred miles of use is equivalent to 400,000 steps walking or 40,000 strides running.

The present inventor believes that a more efficient and durable method for providing cushioning in footwear would be to harness and utilize a cushioning method that uses deflection as a way to provide cushioning. A trampoline is a good example of using deflection as a way to cushion. A trampoline is durable, retains its shape over time, and has very little energy loss.

SUMMARY

The present invention provides systems and devices providing cushioning and support in association with footwear. The present invention includes technology that can be used as a shoe heel component that can be integrated into the heel of the shoe.

Accordingly, it is a feature of the present invention to utilize a deflection plate within the heel of a shoe or boot for providing shock attenuation and absorption.

It is another feature of the present invention that the plate can be provided in the form of a carbon fiber plate located in the heel of footwear, which accepts the energy, or shock, from a downward step on to the ground by a wearer of the footwear. A carbon fiber plate is preferred because carbon increases energy return, yet minimizes energy loss.

It is another feature of the present invention that a void can be located underneath the carbon fiber plate to allow the plate to bend when pressed down upon, accepting the energy of the downward step.

It is also a feature of the present invention that a post be located near/in the center of the heel underneath the carbon fiber plate to allow support and minimizes catastrophic damage (plastic deformation) to the carbon fiber plate; otherwise, damage would defeat the purpose of the intended invention to provide for shock absorption. Useful aspects of the invention are maintained if the carbon fiber plate is kept from undergoing plastic deformation. Therefore, the post can offer additional support and also prolong the service life of the carbon fiber plate.

DETAILED DESCRIPTION

Figure 1:
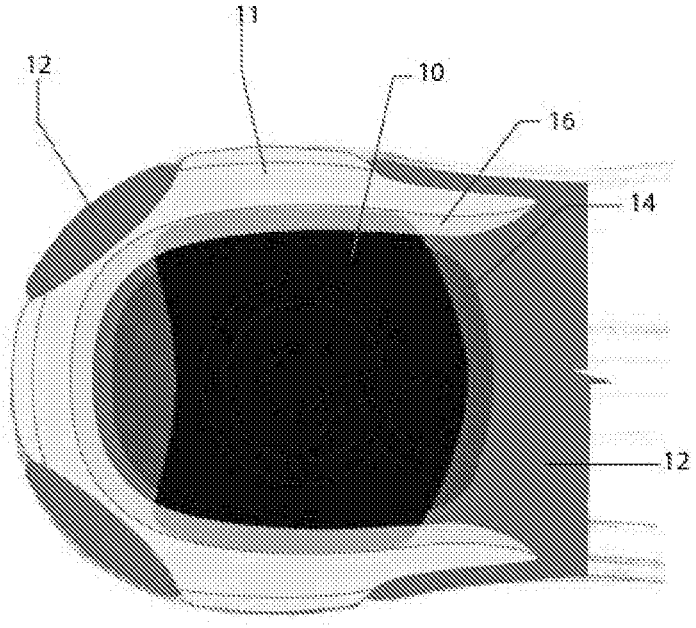
FIG. 1 Is a top view of the cushioning device of the present invention.

Referring to FIGS. 1 through 4, the invention is shown detail. An elastic cushioning device includes an elastic plate 10 that is inserted into grooves 16 of a thermoplastic housing 11 and can also be assembled in a manor so that the elastic plate 10 is free floating within the thermoplastic housing 11. This can be advantageous because the elastic plate can flex unrestricted when placed under a load by the heel of a user's foot on the elastic plate during activity. The elastic plate 10 when assembled into the thermoplastic housing 11 can be placed over a cavity 14 formed in the midsole 12 of a shoe so that the plate 10 when put under load by the foot can deflect downward into the cavity 14. A post 15 placed at, or formed within, the center of the cavity can limit the amount of deflection into the cavity.

Figure 3:
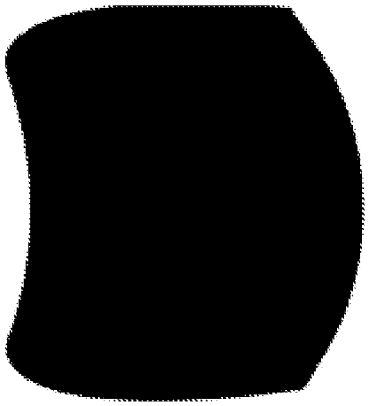
FIG. 3 is a top view of the elastic plate of the present invention.
Figure 4:
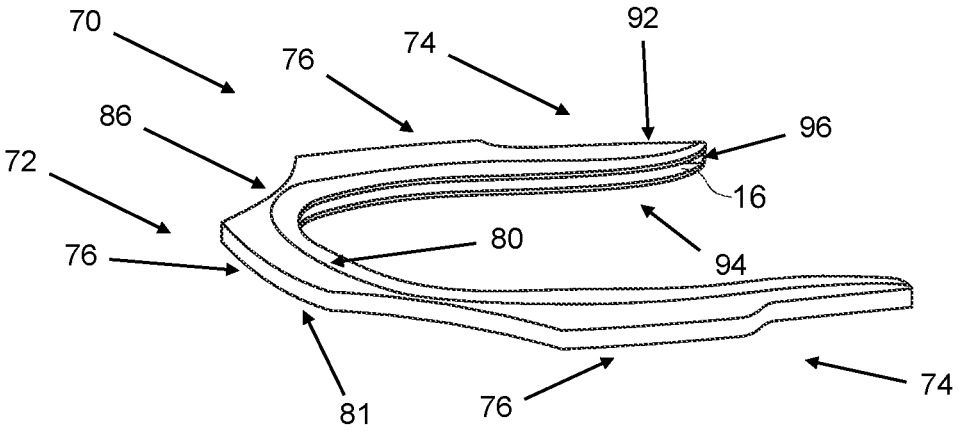
FIG. 4 is a perspective view of the thermoplastic housing for the elastic plate of the present invention.

The preferable material used for the plate shown alone in FIG. 3 is elastic materials such as carbon fiber and/or other elastic composite materials that have a very high rate of rebound (energy return) and a high resistance to breakdown when stressed and released under pressure. These types of elastic materials can be engineered so that the spring constant properties can be modified to accommodate the user's different weights by shoe size, activity, and function. As shown in FIG. 4, the thermoplastic housing can be made of a durable mix of rigid plastic, synthetic, and nylon materials. Although it is envisioned that the housing could also be made of metal, a thermoplastic housing is preferred because it will reduce weight and manufacturing costs.

Figure 5:
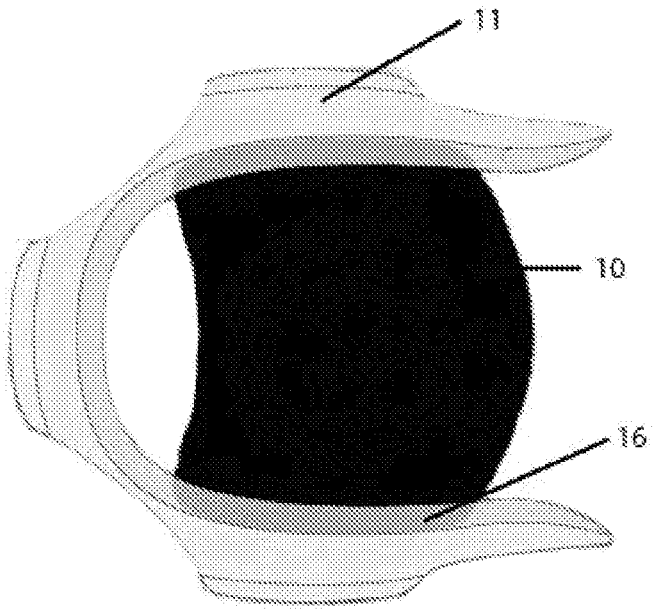
FIG. 5 is a top view of the elastic plate inserted into the thermoplastic housing of the present invention.

The elastic plate 10 can be designed with a shape as shown in FIG. 3 and FIG. 5 so that it does not completely cover the cavity 14 in the midsole 12 when it is placed to rest upon the thermoplastic housing 11 so that air under the elastic plate 10 can escape up and out of the cavity 14 through gaps formed where edges of the elastic plate 10 do not contact the thermoplastic housing 11 when it is flexed downward by the foot, and so that air pressure does not affect the function of the total device.

Figure 6:
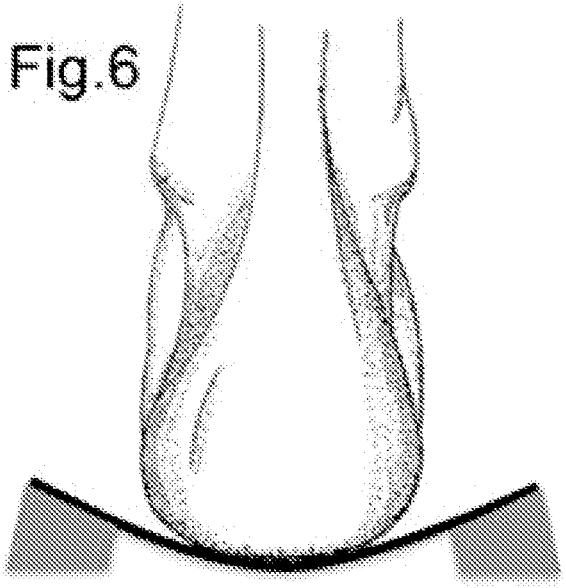
FIG. 6 is a rear view showing how a foot flexes the elastic plate during a pressure.

Referring to the function of the invention, when the elastic plate 10 is put under load from activities such as walking and running, as shown in FIG. 6, a high level of energy return can be achieved due to the fact that the plate is not anchored or restricted at any point, thus allowing it to bend and return freely. The invention functions similar in a way a trampoline functions by storing, releasing, and retuning a high amount of elastic energy.

Figure 2:
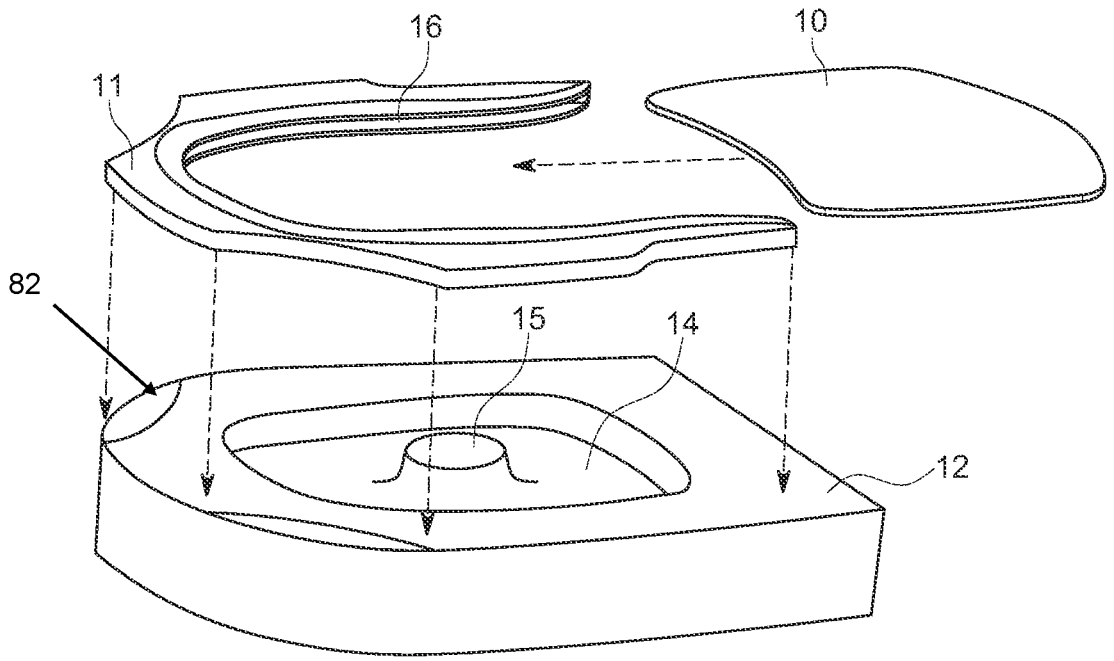
FIG. 2 is an exploded view of the components of the cushioning device of the present invention.
Figure 7:
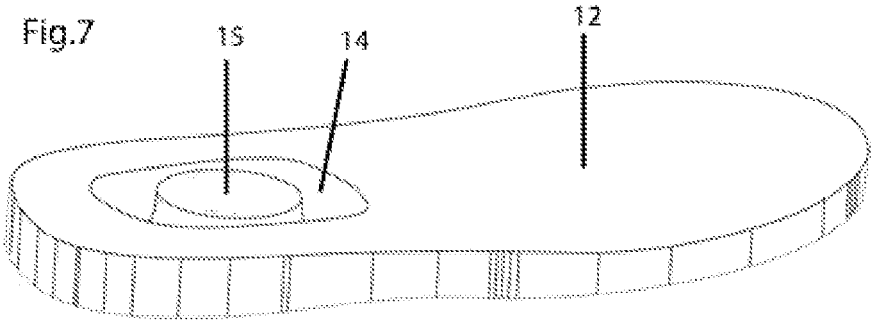
FIG. 7 is a perspective view of a shoe midsole with cavity under which the device is placed.
Figure 8:
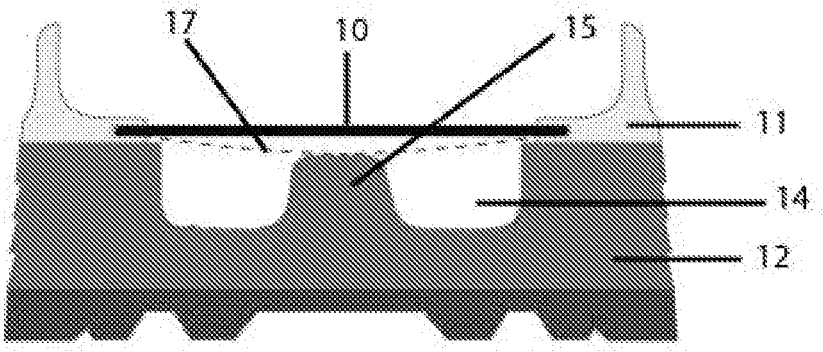
FIG. 8 is a cross section view of the cushioning device of the present invention in both a static and in flexed (dotted line) positions.

In further detail, still referring to the invention of FIG. 1 and FIG. 2, but also FIGS. 7 and 8, the midsole 12 of a shoe has a cavity 14 formed therein in a manner that a soft post 15 remains formed therein and centered within the cavity 14. The soft post 15 functions as a fail safe stop so the elastic plate 10 will not flex 17 excessively and break as shown in FIG. 8. Flexion beyond the post 15 within the cavity could result in the elastic plate 10 breaking or shattering.

Referring to FIG. 8, when the load is released by the heel as the motion of the foot pronates forward, the plate 10 will use kinetic energy to return to its original shape thus providing energy return to the wearer.

The construction details of the present invention as shown in FIG. 1 and FIG. 2 consists of a elastic plate 10, depicted in FIG. 3 that is positioned inside grooves 16 of thermoplastic housing 11 in such a way as the elastic plate 10 is free floating allowing such elastic plate to flex downward 17 of FIG. 8 and to return unimpeded so as to take full advantage of the high energy return properties of such elastic plate 10, thus providing for a cushioning device and energy return that avoids the negatives (high energy loss & rapid breakdown) of current typical compression based cushioning devices. Thermoplastic housing 11 may have a u-shape main body 70 with a top side and a bottom side engageable with the midsole, as illustrated in FIG. 4, main body 70 having a back end portion 72 leading into two spaced side wall portions 74 with a protrusion 76 on each sidewall portion 74 and back end portion 72 whereby protrusions 76 extend laterally outward from main body 70 and are parallel with main body 70 along a vertical axis. Protrusions 76 on back portion 72 and sidewall portions 74 may have a rounded leading end 80 with a rear surface 81 extending from the portions 72 and 74. The protrusion 76 on back end portion 72 may be connected to each of protrusions 76 on sidewall portions 74 by a concave curve 86, whereby protrusions 76 are shaped such that two ellipses portions 82 of the midsole are visible when the thermoplastic housing 11 is inserted into the midsole. Grooves 16 may have a u-shaped upper surface 92 and u-shaped lower surface 94 extending inward from and separated by a surface 96 of thermoplastic housing 11 such that for elastic plate 10 to be positioned inside of grooves 16, elastic plate 10 is laterally slid or inserted between the upper surface and lower surface of grooves 16. When received in grooves 16, elastic plate 10 rests below upper surface of grooves 16 as illustrated in FIG. 1.

The advantages of the present invention include without limitation superior cushioning compared to current cushioning technology, energy return in a manner and degree not utilized in current footwear cushioning shock attenuation systems, light weight than current systems, simple design and construction for ease of manufacturing, superior durability than current shock attenuation systems, and tenability for varied weight loads or functions.

The broad embodiment of the present invention is a cushioning device that is designed to be used in the heel area of a variety of types of footwear not limited to but including athletic, casual, military, hiking, and dress shoes.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

The invention claimed is:

1. A footwear cushioning system, comprising; a deflection plate comprised of carbon fiber and having an edge formed along a perimeter of deflection plate that slides into a groove of a support housing, the groove created between an upper u-shape surface and lower u-shape surface of a support housing by lateral insertion, the deflection plate resting on the lower u-shape surface, wherein the deflection plate is adapted for providing shock attenuation and energy absorption caused by a downward force of a human heel when a wearer of a shoe impacts a hard surface with the heel portion of the shoe, the support housing having a back end portion leading into two spaced side wall portions with a protrusion on each sidewall portion and the back end portion, wherein the protrusion on each sidewall portion and the back end portion extend laterally outward from the main body and are parallel with the main body along a vertical axis; and a midsole, the midsole positioned below the support housing when the support housing is inserted into the shoe, the midsole having a post located near a center of an inner cavity underneath the deflection plate minimizing excessive deflection of the deflection plate when the deflection plate receives the downward force and is allowed to freely move at the edge.

2. The footwear cushioning system of claim 1, wherein the deflection plate is located in the heel portion of the shoe and is adapted to accept energy or shock from a downward step on the heel by the human heel of the wearer of the shoe, wherein the support housing has one or more protrusions extending outward.

3. The footwear cushioning system of claim 1, wherein the post limits deflection of the deflection plate and prevents damage to the deflection plate from plastic deformation.

4. The footwear cushioning system of claim 1, wherein said support housing is formed from thermoplastic material.

5. The footwear cushioning system of claim 1, wherein said support housing is formed from metal.

6. Cushioned footwear, comprising:

a deflection plate integrated into a heel portion of a shoe above a midsole associated with the shoe and located over a cavity formed by a support housing, the deflection plate having a first and second sidewall that detachably slide into a groove created between an upper and lower surface of the support housing wherein the entirety of the deflection plate is below the upper surface when the deflection plate is inserted into the groove, the deflection plate is freely supported over the cavity by an edge, the support housing having a u-shape main body, the support housing having a top side and a bottom side, the bottom side engageable with the midsole, the main body having a back end portion leading into two spaced side wall portions with a protrusion on each sidewall portion and the back end portion, wherein the protrusion on each sidewall portion and the back end portion extend laterally outward from the main body and are aligned with the main body along a vertical axis, the protrusions each comprising a rounded leading end with a rear surface extending from the each sidewall portion and the back end portion, the protrusion on the back end portion connected to each of the protrusions on the sidewall portions by a concave curve, the deflection plate adapted to provide shock attenuation and energy absorption from downward force caused by a human heel when a wearer of the shoe impacts a hard surface with the heel portion of the shoe and the deflection plate is adapted to be pressed downward into the cavity by the human heel of the wearer; the midsole having a post underneath the deflection plate and formed in the midsole, said post minimizing excessive deflection of the deflection plate into the cavity, the cavity allowing the deflection plate to flex into the cavity along the edge when the deflection plate is pressed downward into the cavity to a limit imposed by the post, thereby enabling the deflection plate to accept the energy of a downward step at the heel portion while remaining detachably and freely supported by the edge.

7. The cushioned footwear of claim 6, wherein the groove is U-shaped, wherein the support housing holds the deflection plate along the edge so the deflection plate can flex at its a middle of the deflection plate into the cavity.

8. The cushioned footwear of claim 7, wherein the deflection plate is comprised of carbon fiber.

9. A footwear cushioning system, comprising:

a deflection plate having an edge formed along a perimeter that slides into a support housing having a groove created between a u-shaped upper surface and u-shaped lower surface of a support housing within a heel portion of the shoe wherein the deflection plate rests upon the u-shaped lower surface when positioned inside the support housing, the support housing having a horseshoe shape main body, the support housing the main body having a back end portion leading into two spaced side wall portions with a protrusion on each sidewall portion and the back end portion, wherein the protrusion on each sidewall portion and the back end portion wherein the protrusions extend outward on a horizontal plane past the main body, the deflection plate positioned over an inner cavity of a midsole wherein the deflection plate configured to deflect downward into the inner cavity, the deflection plate configured for providing shock attention and energy absorption caused by a downward force of a human heel when a wearer of the shoe impacts a surface with the heel portion of the shoe.

10. The footwear cushioning system of claim 9, comprising: a soft post of the midsole located near a center of the inner cavity underneath the deflection plate, the post configured to minimize excessive deflection of the deflection plate downward into the inner cavity as force from the human heel pushes down on the deflection plate, wherein the post prevents damage to the deflection plate from deformation.

11. The footwear cushioning system of claim 10, wherein the deflection plate is shaped so as to not completely cover the inner cavity such that when positioned in the groove air escapes up through the inner cavity through gaps where the deflection plate is not in contact with the support housing.

* * * * *